United States Patent [19]

Diaz

[11] 4,206,627

[45] Jun. 10, 1980

[54] UNITARY MOLD-PRESS STRUCTURE

[76] Inventor: Miguel A. Diaz, P.O. Box 95, 283 Paterson Ave., Apt. 3, East Rutherford, N.J. 07073

[21] Appl. No.: 953,635

[22] Filed: Oct. 23, 1978

[51] Int. Cl.[2] ..... B21D 33/00

[52] U.S. Cl. ..... 72/334; 72/379; 72/414; 113/120 G

[58] Field of Search ..... 113/116 Y, 120 R, 120 G, 113/120 CC; 72/319, 379, 414, 415, 470, 324, 333, 334, 335

[56] References Cited

U.S. PATENT DOCUMENTS

| | | | |
|---|---|---|---|
| D. 92,481 | 6/1934 | Maul | D81/25 |
| 152,523 | 6/1874 | Secor | 113/120 G |
| D. 203,910 | 2/1966 | Sachnoff et al. | D81/25 |
| 340,659 | 4/1886 | Churchill | 72/414 |
| 1,714,214 | 5/1929 | Darling | 72/414 |
| 2,133,445 | 10/1938 | Guerin | 72/55 |
| 2,305,866 | 12/1942 | Graf | 113/120 B |
| 3,229,886 | 1/1966 | Grogel | 229/3.5 |
| 3,241,579 | 3/1966 | Partridge | 140/93.2 |
| 3,262,668 | 7/1966 | Luker | 249/117 |
| 3,380,272 | 4/1968 | Halter | 72/57 |
| 3,796,174 | 3/1974 | Wilson | 113/120 G |

FOREIGN PATENT DOCUMENTS

| | | | |
|---|---|---|---|
| 868692 | 5/1961 | United Kingdom | 113/120 G |

*Primary Examiner*—Lowell A. Larson
*Attorney, Agent, or Firm*—R. Martin Oliveras

[57] ABSTRACT

A Unitary Mold-Press Structure comprising a bottom portion, a top portion, and a hinge is utilized to make disposable plates, pans, and stove burner protectors and liners in one simple manual step from aluminum foil. The bottom portion further comprises an aluminum foil source, a mold member, a cutting structure, folding flaps, and a side cutting member. The top portion comprises a handle structure, a side cutter, and a mold member. The hinge allows for rotation of the top portion relative to the bottom portion. The bottom cutting structure includes a cylindrical holder, a cylindrical spring, and first and second cylindrical steel cutters. The top handle structure includes a cylindrical holder, a cylindrical spring, and first and second annular members. The top handle structure and the bottom cutting structure interact to effect the internal cutting function of the aluminum foil.

3 Claims, 2 Drawing Figures

UNITARY MOLD-PRESS STRUCTURE

FIELD OF THE INVENTION

This invention relates to portable unitary mold-press structures and in particular to such structures for forming, cutting, and shaping thin metal foil.

BACKGROUND OF THE INVENTION

The use of thin metal foil such as aluminum foil for making disposable plates, pans, stove burner protectors and liners is well-known in the art. For example, see U.S. Pat. No. Des. 203,910 entitled "*Burner Liner*" and issued on Feb. 2, 1966 to Sachnoff and Levin. Such patent apparently discloses a square burner liner including a central circular opening for allowing flames to emanate from the associated burner. Also known in the prior art is the E-Z Foil Burner Bib (registered trademark) liners for gas and electric ranges manufactured by the E-Z Por (registered trademark) Corporation of Niles, Ill., which are of circular and square shape and which are apparently made of aluminum foil sheet. While the aforementioned burner liners are known in the prior art, a simple method or device for making such types of burner liners in general are not so well known in the prior art, especially such a device which is unitary, portable, manual, lightweight, economical, and easy to manufacture. For example, U.S. Pat. No. 2,133,445 entitled "*Methods For Cutting And Forming Sheet Material*" issued on Oct. 18, 1938 to Guerin, discloses a specific embodiment of a cutting and forming mechanism but does not disclose a device such as the unitary mold-press structure of the present invention. In addition, U.S. Pat. No. 3,229,886 entitled, "*Pie Plate Construction*" issued on Jan. 18, 1966 to Grogel discloses a specific embodiment for a pie plate construction and means for manufacturing same, but does not disclose the unitary mold-press structure of the present invention.

Objects of the present invention are therefore to provide:

(a) A unitary mold-press structure which can be utilized to make disposable plates, pans, stove burner protectors, and liners from thin metal foil, such as aluminum foil;

(b) A unitary mold-press structure which can be used to make the aforementioned products in one or two simple steps;

(c) A unitary mold-press structure which is portable, light, manually operated, economical and easy to manufacture.

SUMMARY OF THE INVENTION

According to the present invention a unitary mold-press structure comprises a bottom portion, a top portion, and a hinge. The bottom portion further comprises an aluminum foil source, a mold member, a cutting structure, flaps, and a side cutting member. The bottom cutting structure includes a cylindrical holder, a cylindrical spring, and first and second cylindrical steel cutters. The respective lower ends of the cylindrical holder, cylindrical spring, and of the first and second steel cutters are fixedly connected to the bottom portion. The cylindrical holder, cylindrical spring, and the first and second cylindrical steel cutters are concentric with each other, the diameter of the cylindrical holder being less than the diameter of the first cylindrical cutter, the diameter of the cylindrical spring being less than the diameter of the cylindrical holder, and the diameter of the second cylindrical steel cutter being less than the diameter of the cylindrical spring. Vertical downward motion of the upper end of the cylindrical spring is effected by the top handle structure as shall be explained in detail hereinafter. The flaps are utilized for folding over the extremities of the formed and shaped aluminum foil as shall also be explained in detail hereinafter. The hinge is associated with respective first edges of the bottom portion and the top portion while the aluminum foil source is associated with a second edge of the bottom portion. The hinge allows for rotation of the top portion relative to the bottom portion. The top portion further comprises a handle structure, a side cutter, and a mold member. The handle structure includes a cylindrical holder, a cylindrical spring, and first and second annular members. The cylindrical holder is free to move perpendicularly relative to the top portion. The first annular member is fixedly connected to the upper end of the cylindrical holder while the second annular member is fixedly connected to the lower end of the cylindrical holder. The cylindrical spring, whose diameter is greater than the diameter of the cylindrical holder, is compressively located between the top portion and the first annular member. The cylindrical holder, the cylindrical spring, and the first and second annular members are concentric to each other. Vertical downward motion of the cylindrical holder perpendicular to the top portion effects further compression of the top cylindrical spring and compression of the bottom cylindrical spring during the forming, cutting, and shaping process.

Operation of the unitary mold-press structure of the present invention is as follows:

The operator pulls, for example, the aluminum foil out of the foil source and across the upper face of the bottom portion; the operator then rotates the top portion about the hinge onto the bottom portion whereby the top side cutter and the bottom side cutting member interact to cut the aluminum foil along, adjacent, and parallel to the foil source; at this juncture the top and bottom mold members form and shape the aluminum foil which is now essentially sandwiched in between the lower face of the top portion and the upper face of the bottom portion; the operator then presses downwardly upon the top handle structure thereby causing the first and second bottom cylindrical steel cutters to cut circular holes centrally on the aluminum foil where desired for a given case. In particular, vertical downward motion of the first annular member effects further compression of the top cylindrical spring and the simultaneous motion of the second annular member effects compression of the bottom cylindrical spring, whereby the first and second bottom cylindrical steel cutters cut the aluminum foil as aforesaid.

Features of the present invention are therefore that:

(a) it includes a bottom cylindrical spring;

(b) it includes at least one bottom cylindrical steel cutter;

(c) it includes a top cylindrical spring.

Advantages of the present invention are therefore that:

(a) it is a unitary portable structure;

(b) it is manually operated;

(c) it is lightweight, economical, and easy to manufacture.

BRIEF DESCRIPTION OF THE DRAWING

Other objects, features, and advantages of the present invention will be better appreciated by a consideration of the following detailed description and the drawing in which.

DETAILED DESCRIPTION

Figure 1:
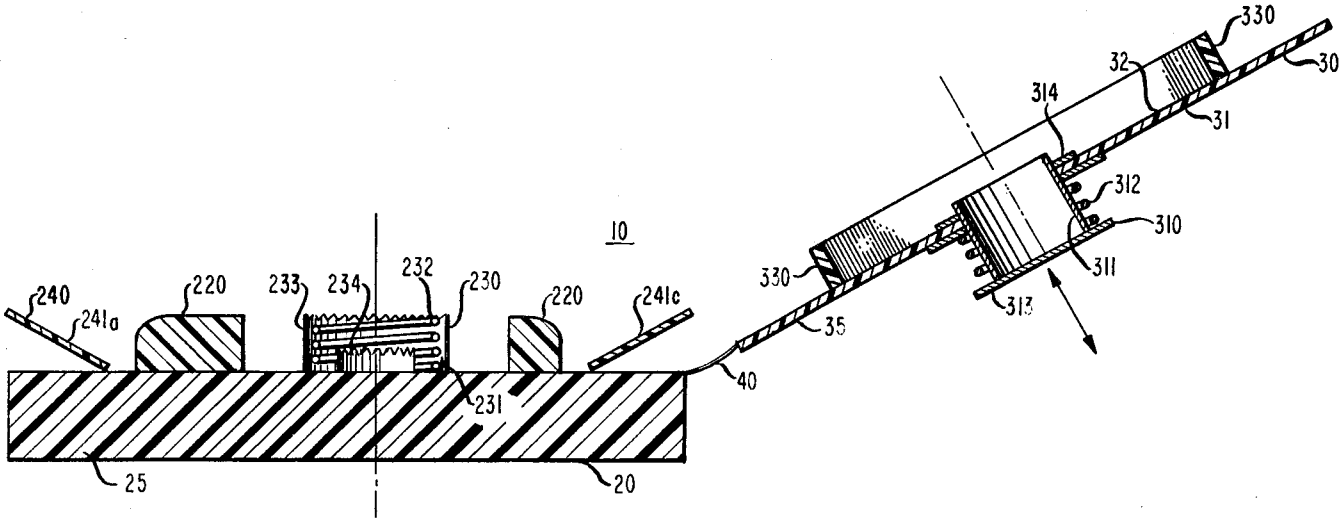
FIG. 1 is a cross sectional side view of the unitary mold-press structure in its partially opened configuration along a vertical plane directly through the center of the handle structure and parallel to the aluminum foil source according to the present invention.

FIG. 1 is a cross sectional side view of unitary mold-press structure 10 in its partially opened configuration along a vertical plane directly through the center of handle structure 310 and parallel to aluminum foil source 210. Unitary mold-press structure 10 comprises bottom portion 20, top portion 30, and hinge 40. It should be noted that the particular material utilized in accordance with the present invention can be either aluminum foil, any other thin metalic foil, thin paper, a thin plastic, or any suitable or shapeable material which can be utilized with the subject unitary mold-press structure. Bottom portion 20 further comprises aluminum foil source 210, mold member 220, cutting structure 230, flaps 241*a*, 241*b*, 241*c*, and 241*d*, and side cutting member 250. Hinge 40 is associated with respective first edges of bottom portion 20 and top portion 30, while aluminum foil source 210 is associated with a second edge of bottom portion 20 perpendicular to the first edge of bottom portion 20. Cutting structure 230 includes cylindrical holder 231, cylindrical spring 232, cylindrical steel cutter 233, and cylindrical steel cutter 234. Holder 231, spring 232, cutter 233, and cutter 234 are concentric to each other. The diameter of cutter 234 is less than the diameter of holder 231, the diameter of holder 231 is less than the diameter of spring 232, and the diameter of spring 232 is greater than the diameter of cutter 233. The respective lower ends of holder 231, spring 232, cutter 233, and cutter 234 are fixedly connected to base 25 of bottom portion 20. Vertical downward motion of the upper end of spring 232 is effected by top handle structure 310 as shall be hereinafter explained in detail. The shape and other physical characteristics of bottom mold member 220 are a matter of choice and determined by the particular shape or form desired from the aluminum foil. Hinge 40 allows for rotation of top portion 30 relative to bottom portion 20. Top portion 30 further comprises handle structure 310, side cutter 320, and mold member 330. Side cutter 320 is associated with the second edge of top portion 30 in the same manner that bottom side cutting member 250 is associated with the second edge of bottom portion 20. Top side cutter 320 including teeth 321 interacts with bottom-side cutting member 250 to effect cutting of the aluminum foil adjacent, along, and parallel to aluminum foil source 210 of bottom portion 20. Again the shape and other physical characteristics of top mold member 330 are a matter of choice and determined by the particular shape and/or form desired of the aluminum foil. Top handle structure 310 includes cylindrical holder 311, cylindrical spring 312, first annular member 313, and second annular member 314. Annular member 313 is fixedly connected to one end of holder 311 while annular member 314 is fixedly connected to the other end of holder 311. Holder 311 is free to move perpendicular to base 35 of top portion 30. Spring 312 is compressively located between annular member 313 and top face 31 of top portion 30.

Figure 2:
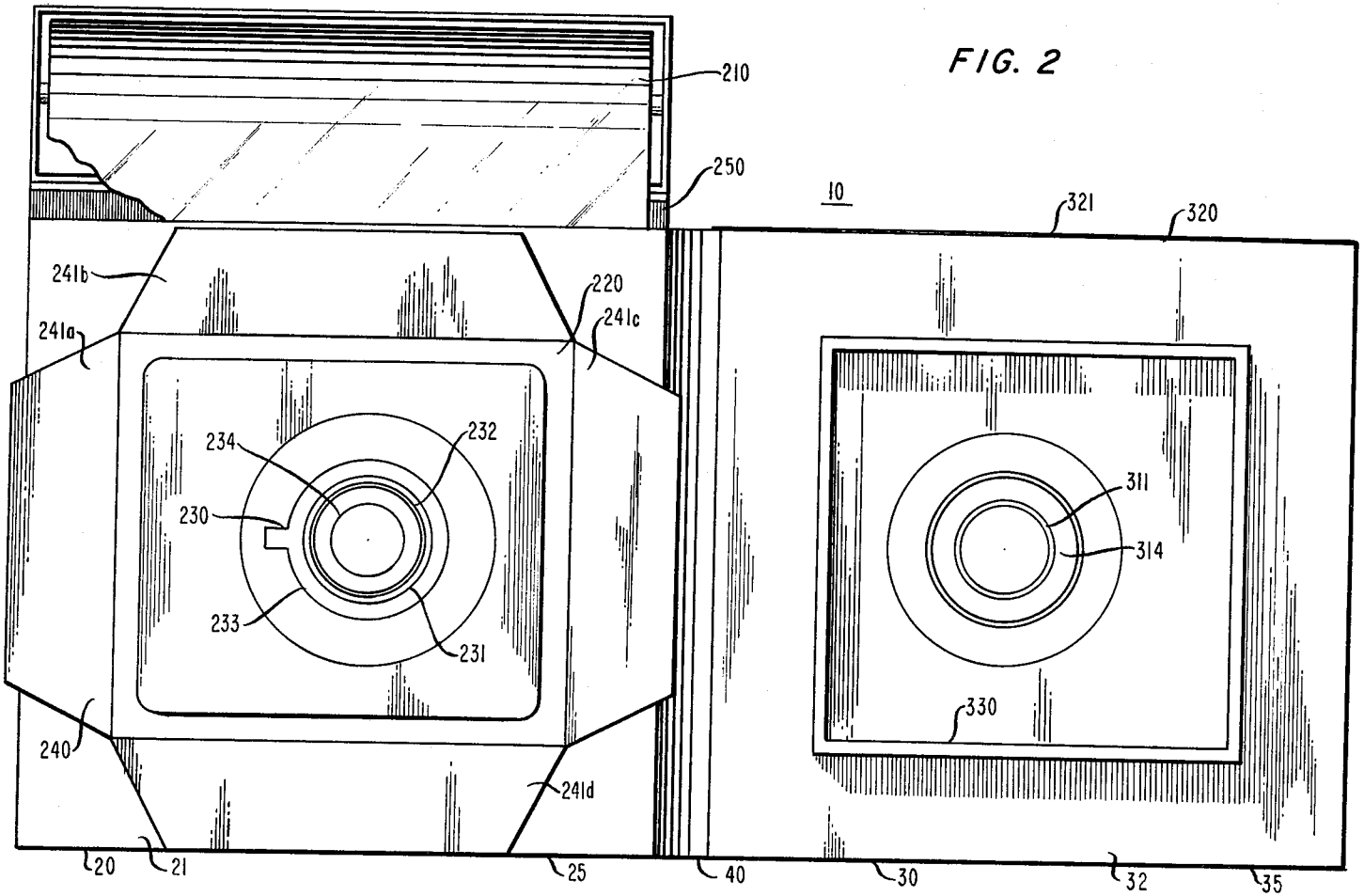
FIG. 2 is a top view of the unitary mold-press structure in its most opened configuration according to the present invention.

FIG. 2 is a top view of the unitary mold-press structure in its most opened comfiguration according to the present invention. FIG. 2 shows the top face of bottom portion 20 and the bottom face of top portion 30 in addition to the other elements comprising bottom portion 20 and top portion 30.

The spacing between and the diameters of the elements included in bottom cutting structure 230 and in top handle structure 310 are a matter of choice and determined by the location and size of the hole desired in the aluminum foil. Accordingly, interchangeable mold members, bottom cutting structures, and top handle structures can be utilized as desired according to the present invention. The unitary mold-press structure of the present invention is therefore versatile and adaptable to suit the needs of any particular desired product.

In FIG. 2, base 25 of bottom portion 20 further includes surface 21 and base 35 of top portion 30 further includes surface 32. Flap structure 240 further includes bottom flaps 241*a*, 241*b*, 241*c*, and 241*d*.

Operation of unitary mold-press structure 10 is as follows:

The operator pulls the aluminum foil out of aluminum foil source 210 across the top face of bottom portion 20; the operator then rotates top portion 30 about hinge 40 and on to bottom portion 20 whereupon top side cutter 320 and bottom sidecutting member 250 interact to cut the aluminum foil along, adjacent, and parallel to aluminum foil source 210; simultaneously top mold member 330 and bottom member 220 interact to shape and mold the piece of aluminum foil which is now located or sandwiched in between bottom portion 20 and top portion 30; the operator then presses vertically downward onto annular member 313 thereby effecting further compression of top cylindrical spring 312 and compression of bottom cylindrical spring 232, whereby the requisite circular hole is cut and located in the aluminum foil piece where appropriate for a given case; the operator then effects rotation of top portion 30 about hinge 40 relative to bottom portion 20 away from bottom portion 20 thereby exposing the shaped, formed, and cut aluminum foil piece; the operator then utilizes bottom flaps 240*a*, 240*b*, 240*c*, 240*d*, to fold over the extremities of the formed, shaped, and cut aluminum foil piece whereby the aluminum foil item is ready for use.

While the unitary mold-press structure according to the present invention has been described in terms of a specific embodiment it would be apparent to those skilled in the art that many modifications are possible within the spirit and scope of the disclosed principle.

What is claimed is:

1. A unitary mold-press structure for making shaped forms out of thin sheet material comprising:

a base portion including a lower base portion, a first edge, a second edge perpendicular to said first edge, and mold means;

a top portion including an upper base portion, a first edge, a second edge perpendicular to said first edge, and mold means;

hinge means associated with the respective first edges of said bottom portion and said top portion for allowing rotation of said top portion relative to said bottom portion;

whereby said thin sheet material located between said bottom mold means and said top mold means is formed and shaped when said top portion is rotated towards and pressed onto said bottom portion;

said bottom portion also includes cutting means further including: at least one vertically directed cutting member, the lower end of said cutting member' being fixedly connected to said lower base portion; first spring means being concentric with said cutting member, the lower end of said first spring means being fixedly connected to said lower base portion;

said top portion also including handle means, said handle means further including holder means being perpendicular and movable relative to said upper base portion; a first annular member being fixedly connected to the upper end of said holder means; a second annular member being fixedly connected to the lower end of said holder means; and second spring means also being perpendicular to said upper base portion, said second spring means being located between said first annular member and said upper base portion;

whereby vertical downward motion of said first annular member effects further compression of said second spring means and effects further compression of said first spring means, and whereby said bottom cutting means and said top handle means interact to cut a hole in said thin sheet material located between said bottom mold means and said top mold means.

2. The unitary mold-press structure of claim 1 wherein: said bottom portion also includes thin sheet material source means located along the second edge of said bottom portion; and thin sheet material cutting means associated with the respective second edges of said bottom portion and said top portion;

whereby said thin sheet material located within said sheet material source means can be positioned across said bottom mold means and whereby said thin sheet material is cut to a pre-determined size by the interaction of said sheet material cutting means upon rotation of said top portion onto said bottom portion.

3. The unitary mold-press structure of claim 1 wherein said bottom portion also includes a third edge, and a fourth edge perpendicular to said third edge; and flap means associated with the first, second, third, and fourth edges of said bottom portion for folding over the extremities of said formed and shaped thin sheet material.

* * * * *